US007079661B2

(12) United States Patent
Tanaka

(10) Patent No.: US 7,079,661 B2
(45) Date of Patent: Jul. 18, 2006

(54) SPEAKER FOR SUPER-HIGH FREQUENCY RANGE REPRODUCTION

(75) Inventor: Shoji Tanaka, Kobe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 19 days.

(21) Appl. No.: 10/500,182

(22) PCT Filed: Jan. 27, 2003

(86) PCT No.: PCT/JP03/00752

§ 371 (c)(1),
(2), (4) Date: Jun. 25, 2004

(87) PCT Pub. No.: WO03/065762

PCT Pub. Date: Aug. 7, 2003

(65) Prior Publication Data

US 2005/0018870 A1 Jan. 27, 2005

(30) Foreign Application Priority Data

Jan. 30, 2002 (JP) ..... 2002-021448

(51) Int. Cl.
*H04R 25/00* (2006.01)

(52) U.S. Cl. ..... 381/190; 381/423; 381/430

(58) Field of Classification Search ..... 381/173, 381/190, 386, 423, 424, 430; 310/324, 327
See application file for complete search history.

(56) References Cited

U.S. PATENT DOCUMENTS 4,386,241 A * 5/1983 Maeda ..... 381/190
4,414,436 A * 11/1983 Sashida et al. ..... 381/190
4,558,249 A * 12/1985 Lerch et al. ..... 381/190
4,654,554 A * 3/1987 Kishi ..... 381/190

FOREIGN PATENT DOCUMENTS

JP 2000-333295 11/2000

* cited by examiner

*Primary Examiner*—Suhan Ni
(74) *Attorney, Agent, or Firm*—Sheridan Ross P.C.

(57) ABSTRACT

A speaker is provided that is operable to reproduce ultrahigh frequencies. Specifically, the speaker outputs ultrahigh frequencies up to 100 kHz with stable sound pressure. The speaker may include a disk-shaped piezoelectric ceramic vibrator wherein a piezoelectric ceramic and a metal substrate are bonded; a dome-shaped diaphragm attached to the piezoelectric ceramic vibrator; and a panel that fixes an outer peripheral part of the piezoelectric ceramic vibrator.

2 Claims, 12 Drawing Sheets

PRIOR ART

SPEAKER FOR SUPER-HIGH FREQUENCY RANGE REPRODUCTION

TECHNICAL FIELD

The present invention relates to a speaker for reproducing ultrahigh sounds up to 100 kHz.

BACKGROUND ART

In these years, recording media for recording high-definition and ultra wideband sources such as a DVD-Audio and a Super Audio CD have been widely spread on the market. In order to reproduce these sources, a speaker capable of reproducing ultrahigh frequencies up to about 100 kHz (what is called a tweeter or a supertweeter) has been demanded. With the price reduction of recording media such as the DVD-Audio and the Super Audio CD and of reproducing apparatuses thereof, an inexpensive speaker capable of reproducing up to ultrahigh frequencies has been demanded as a single unit component or an element for a compact stereo.

Japanese Laid-open Patent Application No. 2000-333295 describes a speaker in accordance with a first prior art, having: a cone-shaped diaphragm, an outer peripheral part of which is supported by a frame; and a monomorph type piezoelectric ceramic vibrator connected to a top part of the cone-shaped diaphragm (FIG. 5 of the Laid-open Patent Application).

The above-mentioned Laid-open Patent Application describes a speaker in accordance with a second prior art, having: a frame; a cone-shaped diaphragm, the outer peripheral part of which is fixed to the frame with an adhesive; a dome-shaped diaphragm having contact with an inner peripheral part of the cone-shaped diaphragm; and a piezoelectric element adhered to the outer peripheral part of the dome-shaped diaphragm (FIG. 6 of the Laid-open Patent Application).

The above-mentioned Laid-open Patent Application discloses a speaker for high frequency in accordance with a third prior art, which is improved in performance as compared to the first and second prior arts, having a structure wherein the diaphragm is attached to the piezoelectric ceramic vibrator (FIG. 1 of the Laid-open Patent Application).

A speaker for high frequency in accordance with the third prior art will be explained with reference to FIG. 14 to FIG. 16. FIG. 14 is a view showing a structure of the speaker for high frequency in accordance with the third prior art.

In FIG. 14, a numeral 21 designates a piezoelectric ceramic vibrator, a numeral 22 designates a frame, a numeral 23 designates a dome-shaped diaphragm, a numeral 24 designates an opening, and a numeral 25 designates a fixing member.

The piezoelectric ceramic vibrator 21 is a circular ring-shaped ceramic piezoelectric element, in which silver electrodes are provided on the both faces thereof and which are polarized in the through-thickness direction. In the piezoelectric ceramic vibrator 21, the inner peripheral part is fixed to the frame 22 via the fixing member 25 of an elastic body. The piezoelectric ceramic vibrator 21 expands and contracts in the radial direction and vibrates evenly throughout a circumference thereof. The dome-shaped diaphragm 23 of 20 mm diameter, which is formed of 35 μm thick polyetherimide films, is fixed to the outer peripheral part of the piezoelectric ceramic vibrator 21 with the adhesive. The dome-shaped diaphragm 23 converts the radial vibration of the piezoelectric ceramic vibrator 21 into the vertical vibration. The above-mentioned structure enables the speaker for high frequency in accordance with the third prior art to achieve wide radiation area, high sound pressure level, and fewer irregularities in the sound pressure frequency response than the case when the cone-shaped diaphragm or the like is used. FIG. 16 shows the sound pressure frequency response of the speaker for high frequency in accordance with the third prior art (wherein the frequency is shown on the horizontal axis and the sound pressure is shown on the vertical axis, and the same applies hereinafter). The speaker for high frequency in accordance with the third prior art has shown its efficient performance in reproducing a conventional source having a frequency band of 20 kHz or less.

In the speaker for high frequency in accordance with the third prior art, the circular ring-shaped piezoelectric ceramic vibrator 21 is fixed in the inner peripheral part, and the diaphragm 23 is attached to the outer peripheral part which is a counter pole thereof. The parts (a) to (c) of FIG. 15 show three vibration modes of the circular ring-shaped piezoelectric ceramic vibrator which is fixed in the inner peripheral part. The upper drawings of the parts (a) to (c) of FIG. 15 are plan views showing the vibrating piezoelectric ceramic vibrator 21. In FIG. 15, the part (a) shows a primary (fundamental frequency) mode, the part (b) shows a secondary node circle mode, and the part (c) shows a tertiary node circle mode. The hatched part shows the displacement in the opposite direction to the non-hatched part (i.e., the boundary between the hatched part and the non-hatched part is a node of the vibration).

The bottom drawings of the parts (a) to (c) of FIG. 15 show the state of displacement of the piezoelectric ceramic vibrator (wherein the amplitude of the vibration is shown on the axis of ordinate, and the piezoelectric ceramic vibrator vibrates in the radial direction actually). As shown in FIG. 15, the outer peripheral part of the piezoelectric ceramic vibrator 21, to which the dome-shaped diaphragm 23 is connected, becomes an antinode in all vibration modes. The vibration only in the outer peripheral part of the piezoelectric ceramic vibrator 21 is transmitted to the dome-shaped diaphragm 23, being likely to cause the speaker for high frequency in accordance with the third prior art to generate resonance in the structure. Hence, according to the structure in accordance with the third prior art, peak/dip of the sound pressure frequency response become very large. As shown in FIG. 16, the speaker for high frequency in accordance with the third prior art has a large peak in the vicinity of about 27 kHz in sound pressure frequency response thereof.

In the speaker for high frequency using a circular shaped piezoelectric ceramic vibrator without modification, since its impedance is very high, flat sound pressure frequency response will not be obtained, and, furthermore, sound pressure level will be low. The speaker in accordance with the third prior art obtained high sound pressure level by making the diaphragm area large. The diaphragm of the speaker in accordance with the third prior art was therefore allowed to become large in diameter. Generally, in a speaker, a larger diaphragm degrades the directional pattern.

The upper cut-off frequency of sources reproduced by the DVD Audio or the Super Audio CD is about 96 kHz. The speaker for high frequency in accordance with the third prior art has not been capable of reproducing efficiently such high-definition and ultra wideband sources in performance. As shown in FIG. 16, the speaker for high frequency in accordance with the third prior art has large peak/dip in the range exceeding 20 kHz and can obtain an efficient sound pressure only up to about 40 kHz.

The piezoelectric ceramic vibrator 21 used in the speaker for high frequency in accordance with the third prior art has a circular ring-shaped special form, resulting in very high cost.

The present invention is to solve the above-mentioned conventional problems, and an object thereof is to provide an inexpensive speaker for reproducing ultrahigh frequencies, having superior sound pressure frequency response wherein the peak/dip is small and the upper cut-off frequency exceeds 100 kHz, high sound pressure level, and excellent directional pattern.

DISCLOSURE OF INVENTION

In order to achieve the above-mentioned object, the present invention has a following configuration.

A speaker for reproducing ultrahigh frequencies in accordance with one aspect of the present invention comprises: a schematically disk-shaped piezoelectric ceramic vibrator in which a piezoelectric ceramic and a metal substrate are bonded; a dome-shaped diaphragm attached to the above-mentioned piezoelectric ceramic vibrator; a panel which fixes an outer peripheral part of the above-mentioned piezoelectric ceramic vibrator and has an opening part in a front face of the above-mentioned dome-shaped diaphragm, wherein a diameter of the dome part of the above-mentioned dome-shaped diaphragm is made to be 0.5 to 0.8 times the effective movable diameter of the above-mentioned piezoelectric ceramic vibrator.

The present invention obtains an inexpensive speaker for reproducing the ultrahigh frequencies, having superior sound pressure frequency response wherein the peak/dip is small and the upper cut-off frequency exceeds 100 kHz, high sound pressure level, and excellent directional pattern.

"The diameter of the dome part" means the diameter of the face wherein the dome part of the dome-shaped diaphragm is bonded to the piezoelectric ceramic vibrator (which does not mean the double value of a curvature of the dome part). In the measure of the diameter of the dome part, the horizontal flange portion around the dome part is not included.

The above-mentioned speaker for reproducing ultrahigh frequencies in accordance with another aspect of the present invention is configured so that the diameter of the above-mentioned piezoelectric ceramic is almost identical to the diameter of the above-mentioned dome part.

The present invention obtains an efficient speaker for reproducing ultrahigh frequencies in which most vibrations generated by the piezoelectric ceramic are radiated from the dome-shaped diaphragm.

The above-mentioned speaker for reproducing ultrahigh frequencies in accordance with another aspect of the present invention is configured so that the diameter of the above-mentioned opening part is almost identical to that of the above-mentioned dome part. The present invention obtains a speaker for reproducing ultrahigh frequencies having better sound pressure frequency response and a wide directional pattern.

The above-mentioned speaker for reproducing the ultrahigh frequencies in accordance with another aspect of the present invention is configured so that a voltage boosting circuit is connected to the above-mentioned piezoelectric ceramic vibrator. The present invention obtains a speaker for reproducing the ultrahigh frequencies having high sound pressure.

The above-mentioned speaker for reproducing the ultrahigh frequencies in accordance with another aspect of the present invention is configured so that a primary resonance frequency at high frequencies of the above-mentioned dome-shaped diaphragm is made to be higher than a secondary resonance frequency at high frequencies of the above-mentioned piezoelectric ceramic vibrator. The present invention obtains a speaker for reproducing ultrahigh frequencies having higher upper cut-off frequency.

The novel features of the invention are set forth with particularity in the appended claims. The invention as to both structure and content, and other objects and features thereof will best be understood from the detailed description when considered in connection with the accompanying drawings.

Part or all of the drawings are drawn schematically for diagrammatic representation and it should be considered that they do not necessarily reflect relative size and position of components shown therein.

BEST MODE FOR CARRYING OUT THE INVENTION

Hereinafter, embodiments that embody best mode for carrying out the present invention will be described with reference to the drawings.

EMBODIMENT 1

Figure 1:
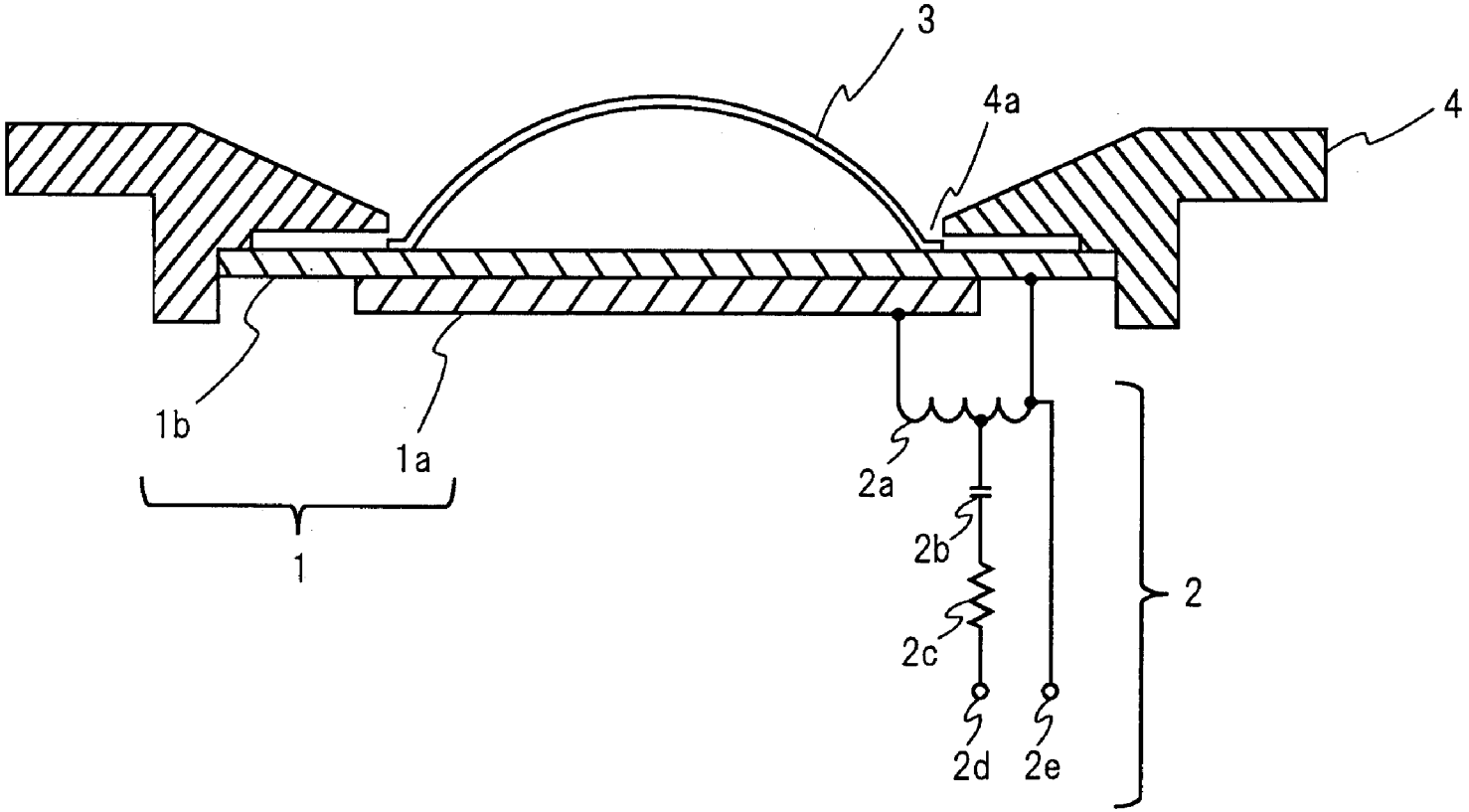
FIG. 1 is a structure view showing a speaker for reproducing ultrahigh frequencies in accordance with Embodiments 1 and 2 of the present invention.

A speaker for reproducing ultrahigh frequencies in accordance with Embodiment 1 of the present invention will be described with reference to FIG. 1 to FIG. 12. FIG. 1 shows a structure of a speaker for reproducing ultrahigh frequencies in accordance with Embodiment 1. In FIG. 1, a numeral 1 shows a piezoelectric ceramic vibrator, a numeral 2 shows a voltage boosting circuit, a numeral 3 shows a dome-shaped diaphragm, and a numeral 4 shows a panel of a front face of a frame.

The piezoelectric ceramic vibrator 1 has a structure wherein a circular shaped piezoelectric ceramic 1*a* polarized in the through-thickness direction and a circular shaped metal substrate 1*b* are coaxially bonded. The piezoelectric ceramic 1*a* has 15 mm diameter and 0.2 mm thick. The piezoelectric ceramic 1*a* is an all-purpose circular shaped compact piezoelectric ceramic used very broadly. The metal substrate 1*b* is made of brass material and has 20 mm diameter and 0.15 mm thick. The metal substrate 1*b* has a larger-diameter than the piezoelectric ceramic 1*a*. The piezoelectric ceramic vibrator 1 is a monomorph type piezoelectric ceramic vibrator wherein a piezoelectric ceramic sheet is adhered to one face of the metal plate.

In the speaker of the third prior art, the vibration in the radial direction of the piezoelectric ceramic vibrator 21 is converted to the vertical vibration (in the through-thickness direction of the piezoelectric ceramic vibrator 21) by a dome-shaped diaphragm 23 formed of 35 μm thick polyetherimide films.

In the speaker of the present invention, the piezoelectric ceramic vibrator 1 is vibrated in the through-thickness direction by a flexure generated between the metal substrate 1*b* having rigidity and the piezoelectric ceramic 1*a*. Compared to the configuration of the third prior art in which the direction of the vibration is changed by transmitting the vibration from the piezoelectric ceramic vibrator 21 to the flexible dome-shaped diaphragm 23, in the configuration of the present invention, the loss of the vibration is low at the time of transmission of the vibration and the attenuation of the high frequency components is also low. The configuration of the present invention can obtain the sound pressure of the high upper cut-off frequency at the far higher level.

In the dome-shaped diaphragm 3, the piezoelectric ceramic vibrator 1 and an end face of the dome-shaped diaphragm 3 are coaxially attached to a face of the metal substrate 1*b* of the piezoelectric ceramic vibrator 1. The dome-shaped diaphragm 3 is formed of the films of polyethylene terephthalate (commonly known as PET) having 0.05 mm thick. The dome-shaped diaphragm 3 has the dome part having 13 mm diameter and 3 mm overall height. There is a horizontal flange of 1 mm width around the dome part. The flange is adhered to the metal substrate 1*b*.

The panel 4 is attached to the front face of the frame which is not shown. The panel 4 is formed of polystyrol resin having practical rigidity. The panel 4 fixes outer peripheral part (which is the ring-shaped part from 9.5 mm radius to the outermost perimeter (10 mm radius)) of the piezoelectric ceramic vibrator 1 with an adhesive. The piezoelectric ceramic vibrator 1 has about 19 mm effective movable diameter. The effective movable diameter means the largest outer diameter which permits the vibration of the piezoelectric ceramic vibrator 1. In the piezoelectric ceramic vibrator 1, the diameter of the piezoelectric ceramic 1*a* is smaller than that of the metal substrate 1*b*. The outer peripheral part of the metal substrate 1*b* is fixed to the panel 4 with an adhesive.

The panel 4 has an opening part 4*a* of 13 mm diameter in the front face of the dome-shaped diaphragm 3. The panel 4 has a shallow conical part centered on the opening part 4*a*. The conical part is thinnest in the outer peripheral part of the opening part 4*a*. As shown in FIG. 1, the most part of the dome-shaped diaphragm 3 is exposed from the opening part 4*a* of the panel 4, which allows the speaker of the present invention to achieve wide directional pattern.

The diameter of the opening part 4*a* of the panel 4 is identical to that of the dome-shaped diaphragm 3. The panel 4, excluding the above-mentioned adhered part to the outer peripheral part of the piezoelectric ceramic vibrator 1 (the peripheral ring-shaped part of the piezoelectric ceramic vibrator 1), is contacted with neither the dome-shaped diaphragm 3 nor the piezoelectric ceramic vibrator 1. A narrow gap is provided between the panel 4 and the piezoelectric ceramic vibrator 1 as well as the dome-shaped diaphragm 3. The above-mentioned structure prevents the sound wave, which is generated by the part which is movable in the piezoelectric ceramic vibrator 1 and is outer than the dome-shaped diaphragm 3, from radiating outside of the speaker.

The diaphragm 3 is not attached to the outer peripheral part of the piezoelectric ceramic vibrator 1 (which is the connection part between the panel 4 and the piezoelectric ceramic vibrator 1), and the diameter of the dome part is smaller than the effective movable diameter of the piezoelectric ceramic vibrator 1. The diameter of the piezoelectric ceramic 1*a* is almost identical to that of the dome part. Most of the flexure (vibration) generated between the piezoelectric ceramic 1*a* and the metal substrate 1*b* is transmitted to the diaphragm 3. Since the contact part with the diaphragm 3 in the piezoelectric ceramic vibrator 1 (which is almost identical to the contact part between the piezoelectric ceramic 1*a* and the metal substrate 1*b*) is away from the fixed part (the outer peripheral part) of the piezoelectric ceramic vibrator 1, the vibration is hard to be suppressed.

The diameter of the diaphragm 3 is very small, which is 13 mm, and almost whole part of the dome part is exposed from the opening part 4*a* of the panel 4. This enables the speaker of the present embodiment to have excellent directional pattern. In the opening part 4*a* of the panel 4, substantially only the dome part is exposed to the outside. The panel 4 covers the front face of the outer peripheral part of the piezoelectric ceramic vibrator 1 (which is inferior in sound pressure frequency response) so as to interrupt the sound from the part thereof. This provides better sound pressure frequency response of the speaker in accordance with Embodiment 1.

The diameter (13 mm) of the dome part of the dome-shaped diaphragm 3 is 0.68 times the effective movable diameter, 19 mm, of the piezoelectric ceramic vibrator 1, the peripheral part of which is fixed. This (as will hereinafter be described in detail) solves the problem of large peak/dip caused in the speaker of the prior art and obtains excellent sound pressure frequency response.

The voltage boosting circuit 2 comprises a voltage boosting coil 2*a*, a capacitor 2*b*, a resistor 2*c*, an input terminal 2*d* (a hot side) and 2*e* (a ground side).

One end of a serial body comprising the resistor 2*c* and the capacitor 2*b* is connected to the input terminal 2*d* (the hot side), and the other end thereof is connected to a primary terminal of the voltage boosting coil 2*a* which is an autotransformer (in which a primary and a secondary windings are not separately wound). A ground terminal of the voltage boosting coil 2*a* is connected to the input terminal 2*e* (the ground side) and the metal substrate 1*b* of the piezoelectric ceramic vibrator 1. A secondary terminal of the voltage boosting coil 2*a* is connected to the piezoelectric ceramic 1*a*.

The voltage boosting coil 2*a* is a winding of an enamel copper wire of 0.12 mm wire diameter around a compact ferrite core bobbin of 10 mm outer diameter and 10 mm length. The number of coil turns on the primary side connected to the capacitor 2*b* is about 40, and the number of coil turns on the secondary side connected to the piezoelectric ceramic 1*a* is about 240. The voltage boosting coil 2*a* has a 1:6 voltage boosting ratio. The voltage boosting circuit 2 multiplies an input drive voltage by a factor of 6 and applies the boosted drive voltage to the piezoelectric ceramic vibrator 1. The speaker in accordance with the present invention can achieve about 16 dB higher sound pressure level than the speaker without the voltage boosting circuit 2.

The speaker in accordance with Embodiment 1, by increasing inputted drive voltage of the piezoelectric ceramic at the voltage boosting coil 2*a*, achieves higher sound pressure than that of the conventional speaker. The capacitor 2*b* is a compact film capacitor having a few square millimeters having 0.68 μF capacity and 50 V withstand-pressure. A lower cut-off frequency in the voltage boosting circuit 2 is about 20 kHz. The voltage boosting coil 2*a* and the capacitor 2*b* constitute a resonance circuit. The capacity of the capacitor 2*b* is determined so that the resonance frequency of the resonance circuit becomes about 22 kHz. By raising an output level around 22 kHz, the band of the voltage boosting circuit 2 is extended in the lower direction. By changing the resistance value of the resistor 2*c*, Q of the resonance circuit comprising the voltage boosting coil 2*a* and the capacitor 2*b* is changed. The resistance value of the resistor 2*c* is determined so that sound pressure frequency response around 20 kHz of the speaker becomes flat. In Embodiment 1, the resistor 2*c* has a compact resistor of 2.2 ohms impedance and 1 W rated capacity.

Figure 2:
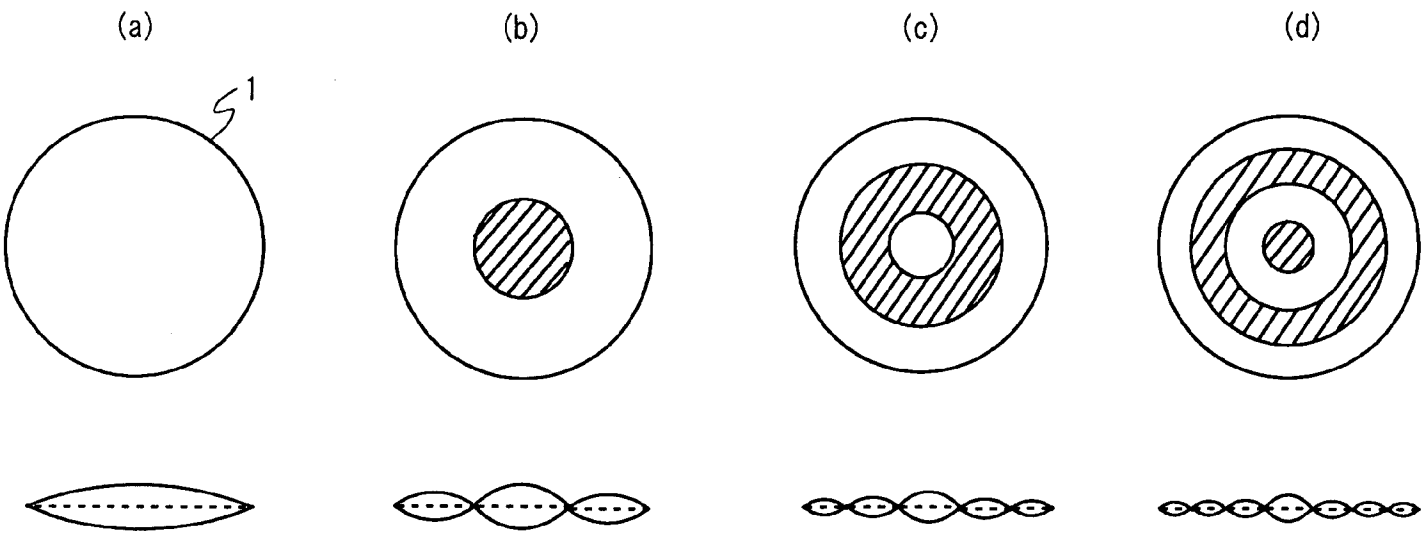
FIG. 2 is a view showing the vibration modes of the piezoelectric ceramic vibrator of the present invention, the peripheral part of which is fixed.

A detailed explanation will be made with reference to FIG. 2 and FIG. 3. The parts (a) to (d) of FIG. 2 are views showing the various vibration modes of the piezoelectric ceramic vibrator 1, the outer peripheral part of which is fixed. The upper drawings of the parts (a) to (d) of FIG. 2 are plan views showing the vibrating piezoelectric ceramic vibrator 1. In FIG. 2, the part (a) shows a primary (fundamental frequency) mode, the part (b) shows a secondary node circle mode, the part (c) shows a tertiary node circle mode, and the part (d) shows a quaternary node circle mode. The hatched part shows the displacement in the opposite direction to the non-hatched part (the boundary between the hatched part and the non-hatched part is the node of the vibration). The bottom drawings of the parts (a) to (d) of FIG. 2 show the state of displacement of the piezoelectric ceramic vibrator 1 (wherein the amplitude of the vibration is shown on the axis of ordinate, and the piezoelectric ceramic vibrator 1 vibrates in the through-thickness direction).

As shown in FIG. 2, in the piezoelectric ceramic vibrator 1, the outer peripheral part of which is fixed, the central part which is the counter pole part to the fixed part becomes an antinode, at which the strongest resonance is caused.

In the speaker in accordance with the third prior art, the piezoelectric ceramic vibrator 21 is a disc ring, the inner peripheral part of which is fixed. In such configuration, the outer peripheral part which is the counter pole part to the fixed part becomes the antinode, at which the strongest resonance is caused. In the third prior art, the outer peripheral part of the piezoelectric ceramic vibrator 21 becomes the antinode in all vibration modes. In the third prior art, since only the outer peripheral part in the piezoelectric ceramic vibrator 21 is connected to the dome-shaped diaphragm 23, the peak/dip of the sound pressure frequency response becomes very large.

In the present embodiment in which the outer peripheral part of the piezoelectric ceramic vibrator 1 is fixed, the vibration modes do not have extreme resonance characteristics and the peak/dip in the frequency response becomes small within the area having certain diameter (for example, an area having the diameter of the piezoelectric ceramic 1*a*). This has been verified by experiment.

The results of the experiment will be explained with reference to FIG. 3. FIG. 3 is a graph showing the sound pressure frequency response of the piezoelectric ceramic vibrator in accordance with Embodiment 1, which has 20 mm outer diameter and the outermost perimeter of which is fixed.

In acoustic theory, it is known that a vibration acceleration multiplied by a radiation resistance of a diaphragm becomes sound pressure frequency response. The sound pressure frequency response shown in FIG. 3 is obtained by measuring the vibration acceleration frequency response and multiplying the measurement result by the radiation resistance.

Figure 3:
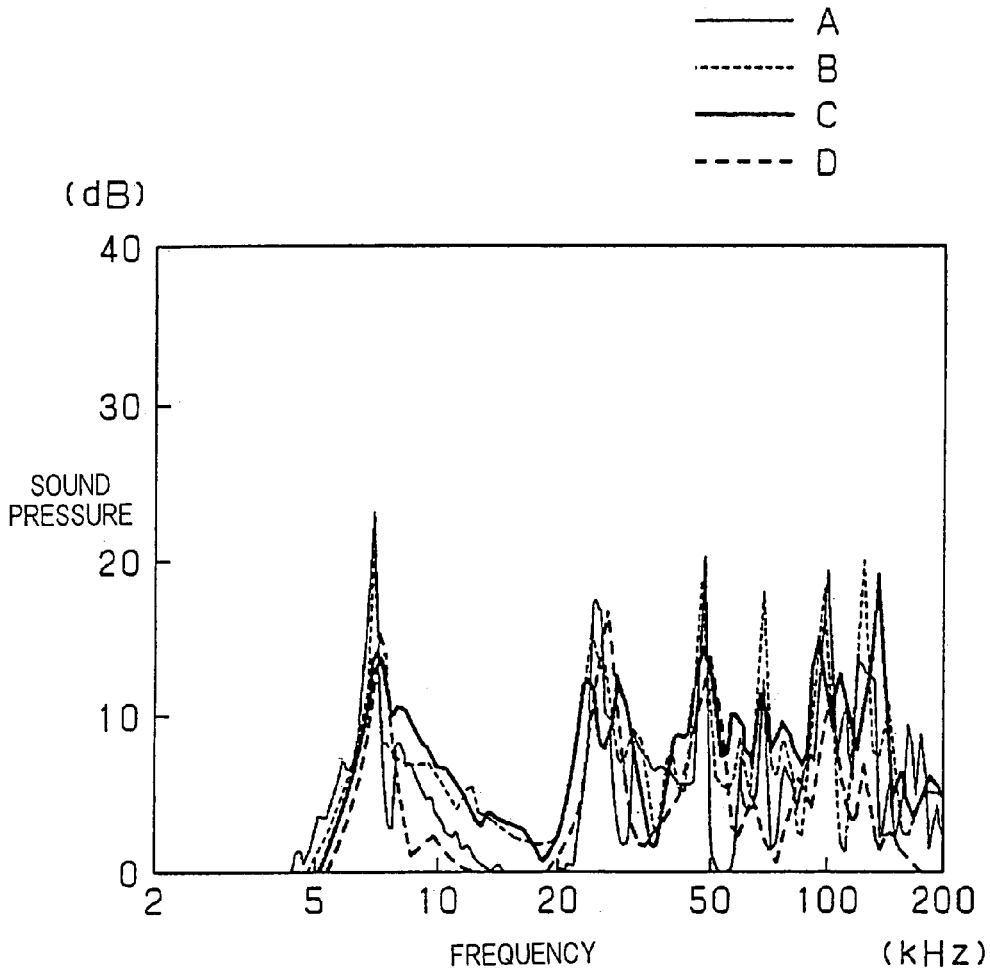
FIG. 3 is a graph showing the sound pressure frequency response of each parts of the piezoelectric ceramic vibrator, the outer peripheral part of which is fixed.

In FIG. 3, lines A to D show responses in the various parts of the piezoelectric ceramic vibrator. The line A (a thin solid line) shows the response at the center point, the line B (a dotted line) shows the response on the peripheral part of 7 mm diameter (0.35 mm from the center), that is, 0.35 times the outer diameter, the line C (a heavy solid line) shows the response on the peripheral part of 13 mm diameter, that is, 0.65 times the outer diameter, and the line D (a broken line) shows the response on the peripheral part of 17 mm diameter, that is, 0.85 times the outer diameter.

As shown in FIG. 3, the response of the line A has the largest peaks/dips and the response of the line B has slightly smaller peaks/dips, but it has still large peaks/dips like the response of the line A. On the other hand, in the response of the line D, the peak/dip is slightly lower in height, but the level as a whole also becomes low, and the level is attenuated when the frequency becomes higher. The response of the line C has the smallest peaks/dips as a whole, and has an even level up to the high frequency.

FIG. 3 shows the response on the part having the typical diameter. According to the experiment, within the range of 10 mm to 16 mm diameter (the range of 5 mm to 8 mm from the center), that is, within the range of 0.5 to 0.8 times the effective movable diameter of the piezoelectric ceramic vibrator, it is found that the response which has small peaks/dips as a whole, like the response of the line C, can be obtained. In the part in this range, intermediate response between those of the line A and the line D can be obtained. Transmitting the vibration of this part to the diaphragm 3 relieves the peak/dip.

FIG. 4 to FIG. 11 and Table 1 show the sound pressure frequency responses in the cases that the dome outer diameter Dd of the dome-shaped diaphragm 3 is changed to be 0.2, 0.3, 0.4, 0.5, 0.6, 0.7, 0.8 and 0.9 times the effective movable diameter Do of the piezoelectric ceramic vibrator, respectively.

At the time of measuring the data of FIG. 4 to FIG. 11, the piezoelectric ceramic vibrator and the effective movable diameter thereof, the voltage boosting circuit, the structure of the panel, the material of the dome-shaped diaphragm and the material of the panel are the same as the content explained in FIG. 1. The opening of the panel in each case is identical to the outer diameter of the dome-shaped diaphragm. A curvature radius of the dome-shaped diaphragm is 9 mm in all cases.

Figure 4:
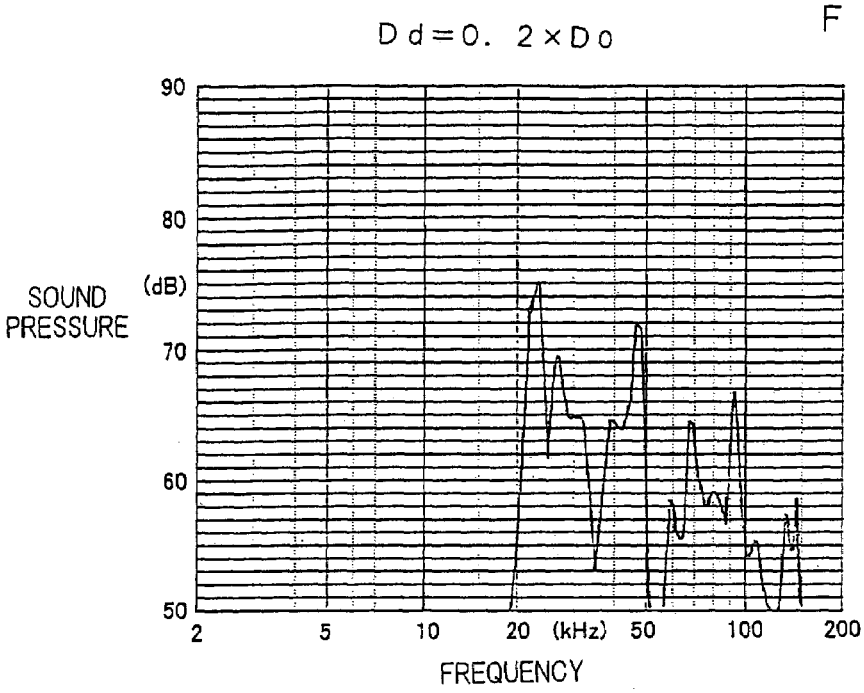
FIG. 4 shows the sound pressure frequency response of the speaker in the case when the diameter of the dome part is made to be 0.2 times the effective movable diameter of the piezoelectric ceramic vibrator.
Figure 5:
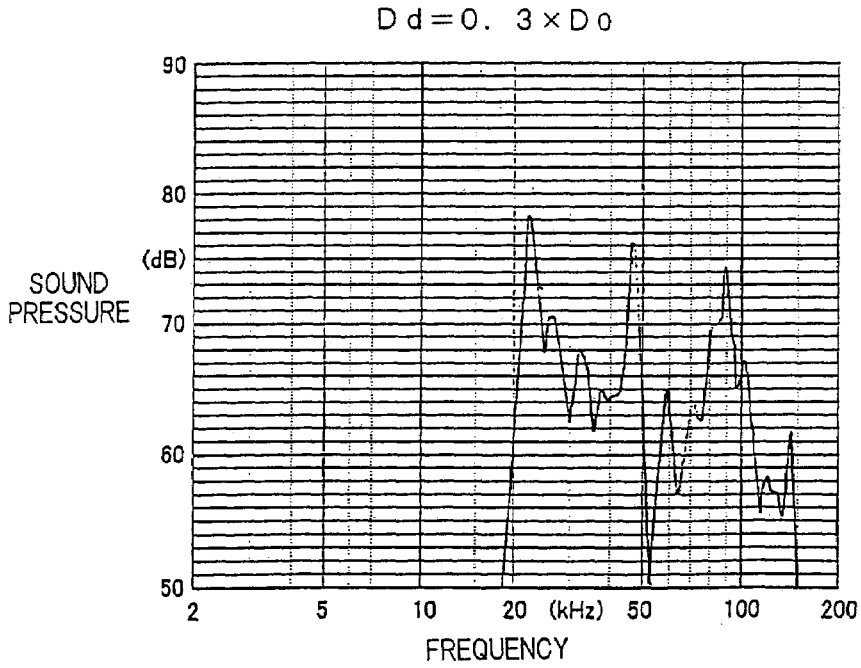
FIG. 5 shows the sound pressure frequency response of the speaker in the case when the diameter of the dome part is made to be 0.3 times the effective movable diameter of the piezoelectric ceramic vibrator.
Figure 6:
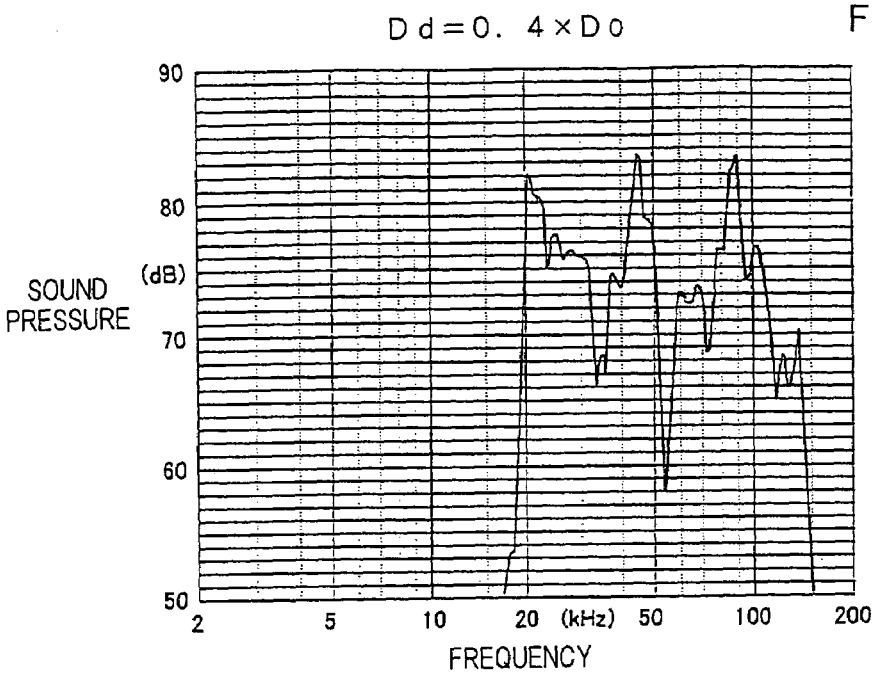
FIG. 6 shows the sound pressure frequency response of the speaker in the case when the diameter of the dome part is made to be 0.4 times the effective movable diameter of the piezoelectric ceramic vibrator.
Figure 7:
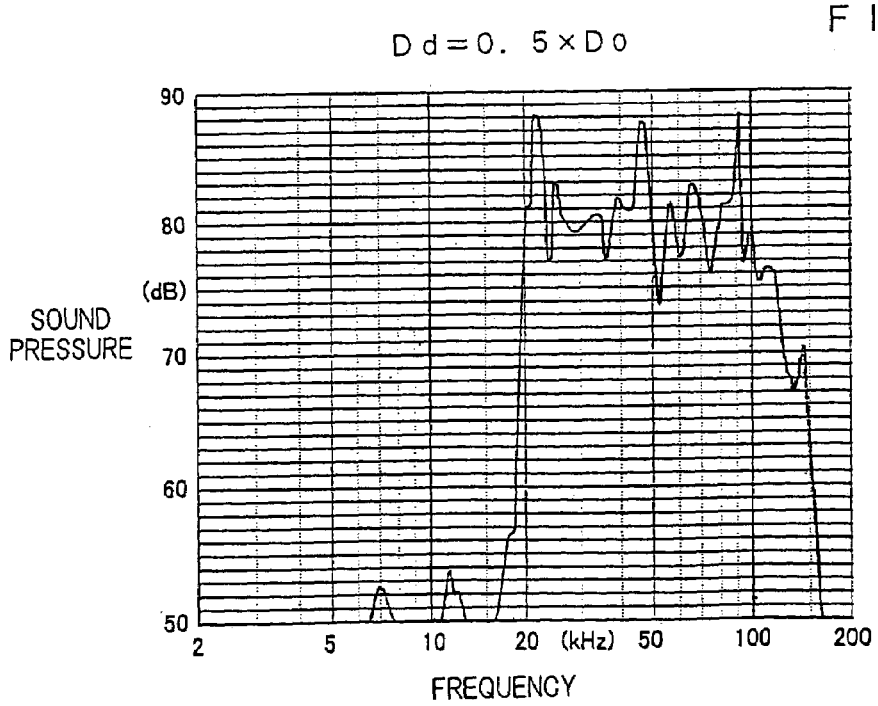
FIG. 7 shows the sound pressure frequency response of the speaker in the case when the diameter of the dome part is made to be 0.5 times the effective movable diameter of the piezoelectric ceramic vibrator.
Figure 8:
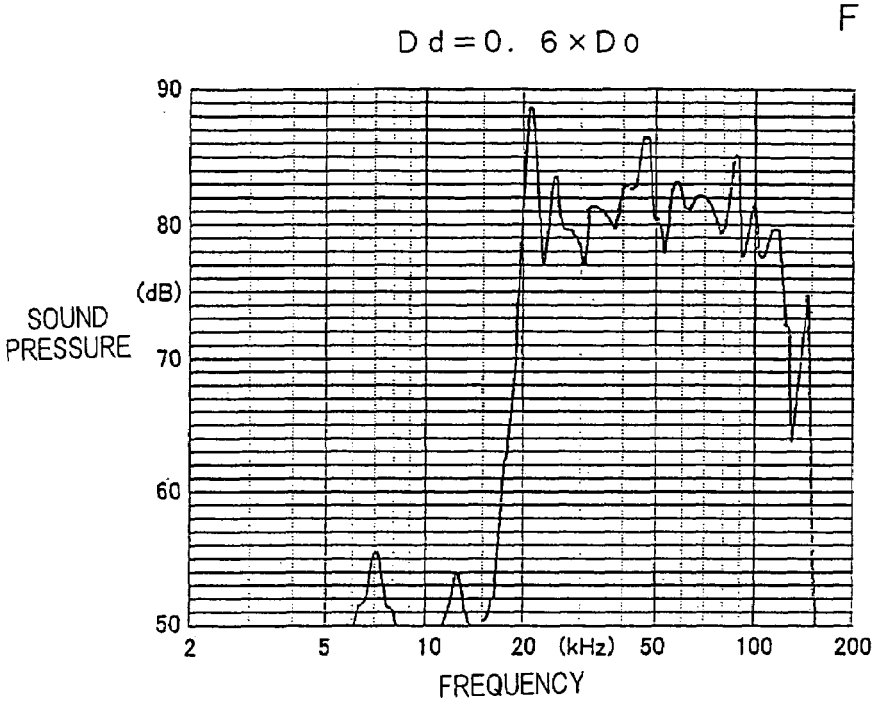
FIG. 8 shows the sound pressure frequency response of the speaker in the case when the diameter of the dome part is made to be 0.6 times the effective movable diameter of the piezoelectric ceramic vibrator.
Figure 9:
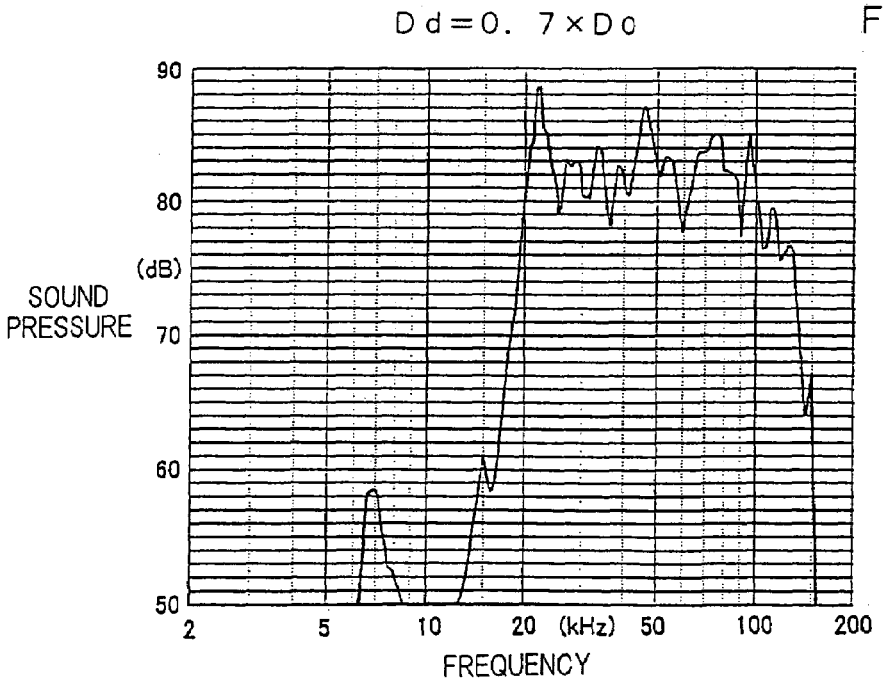
FIG. 9 shows the sound pressure frequency response of the speaker in the case when the diameter of the dome part is made to be 0.7 times the effective movable diameter of the piezoelectric ceramic vibrator.
Figure 10:
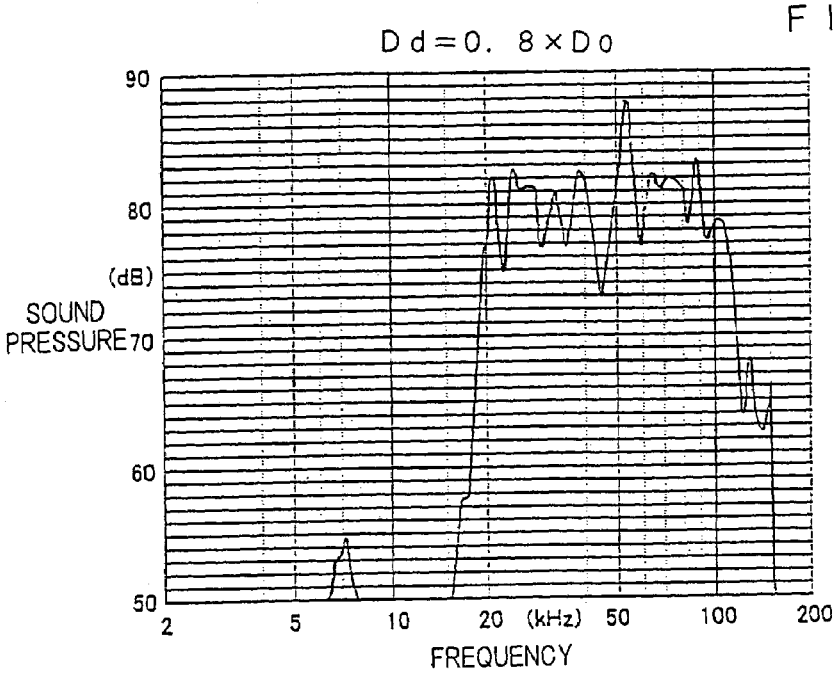
FIG. 10 shows the sound pressure frequency response of the speaker in the case when the diameter of the dome part is made to be 0.8 times the effective movable diameter of the piezoelectric ceramic vibrator.

As shown in FIG. 4 to FIG. 6, in the case that the outer diameter of the dome-shaped diaphragm 3 is small, that is, in the case that the dome outer diameter is 0.2 to 0.4 times the effective movable diameter of the piezoelectric ceramic vibrator 1, the sound pressure frequency response has large peak/dip. Since the center point of the piezoelectric vibrator 1 has the highest resonance level, the part in the vicinity thereof has large peak/dip.

The smaller the dome outer diameter, the lower the overall sound pressure level becomes. It is because the smaller the outer diameter of the diaphragm, the smaller the area of the diaphragm becomes.

As shown in FIG. 7 to FIG. 10, in the case that the outer diameter of the dome-shaped diaphragm 3 is 0.5 to 0.8 times the effective movable diameter of the piezoelectric ceramic vibrator 1, the peak/dip of the sound pressure frequency response is small, and the sound pressure level as a whole is relatively high.

Figure 11:
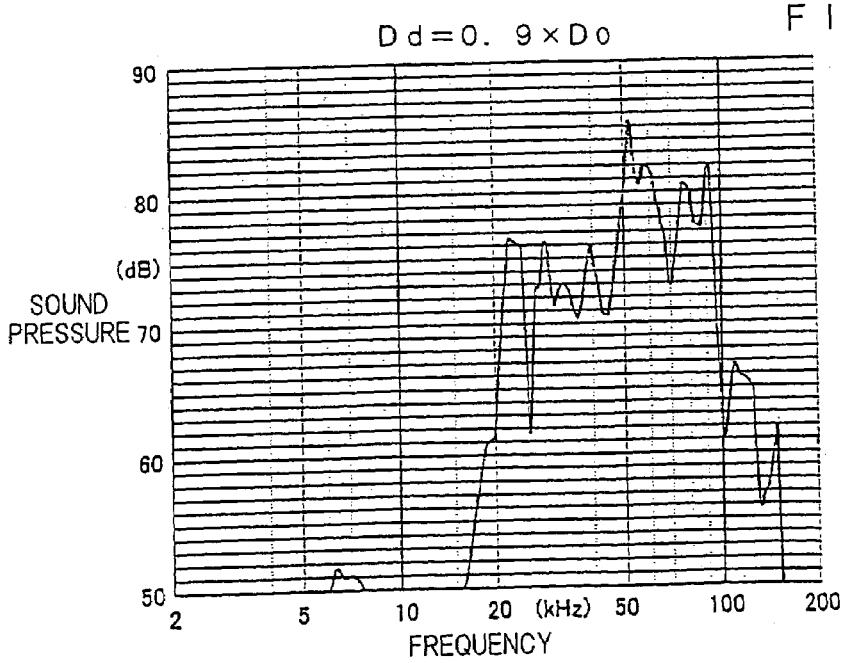
FIG. 11 shows the sound pressure frequency response of the speaker in the case when the diameter of the dome part is made to be 0.9 times the effective movable diameter of the piezoelectric ceramic vibrator.

As shown in FIG. 11, in the case that the dome outer diameter is 0.9 times the effective movable diameter of the piezoelectric ceramic vibrator, the peak/dip is large and the sound pressure level is low. The sound pressure level becomes low in spite that the dome outer diameter is large because the amplitude of the vibrator is attenuated in the part in the vicinity of the outer peripheral fixed end of the piezoelectric ceramic vibrator.

Table 1 is a compilation of the shape of the dome-shaped diaphragm 3 and the tendency of the sound pressure frequency response. In Table 1, "Dd" shows the outer diameter (diameter) of the dome-shaped diaphragm 3, "h" shows the height of the dome (where a curvature radius of the dome is 9 mm in all cases), "R" shows the ratio of the outer diameter of the dome-shaped diaphragm 3 to the effective movable diameter (19 mm) of the piezoelectric ceramic vibrator 1, "d" shows the deviation in 20 kHz to 100 kHz of the sound pressure frequency response (sharp peaks/dips of ⅛ octave or below are excluded), and "Average SPL" (Sound Pressure Level) shows the average sound pressure level of 20 kHz to 100 kHz of the sound pressure frequency response, respectively.

From Table 1, it is apparent that the deviation (the size of the peak/dip) of the sound pressure frequency response is small in the range in which the outer diameter of the dome-shaped diaphragm 3 is 0.5 to 0.8 times the effective movable diameter of the piezoelectric ceramic vibrator 1 (within the range of plus or minus 5 dB). The average SPL becomes large in the range in which the dome outer diameter is 0.5 to 0.8 times the effective movable diameter of the piezoelectric vibrator, and becomes very small in the range in which the dome outer diameter is 0.4 times or less and 0.9 times or less.

According to the above-mentioned result of the experiment, by designing the outer diameter of the dome-shaped diaphragm 3 to be within the range of 0.5 to 0.8 times the effective movable diameter of the piezoelectric ceramic vibrator 1, it is possible to obtain a speaker for reproducing ultrahigh frequencies with excellent response.

TABLE 1

| Dd (mm) | 3.8 | 5.7 | 7.6 | 9.5 | 11.4 | 13.3 | 15.2 | 17.1 |
|---|---|---|---|---|---|---|---|---|
| h (mm) | 0.2 | 0.5 | 0.9 | 1.4 | 2.1 | 3.0 | 4.2 | 6.2 |
| R | 0.2 | 0.3 | 0.4 | 0.5 | 0.6 | 0.7 | 0.8 | 0.9 |
| d (dB) | ±12 | ±11 | ±8 | ±5 | ±4 | ±3 | ±5 | ±7 |
| Average SPL (dB) | 62 | 67 | 75 | 80 | 82 | 82 | 80 | 75 |

In the present embodiment, the diameter of the dome part of the dome-shaped diaphragm 3 is made to be 0.68 times the effective movable diameter of the piezoelectric ceramic vibrator 1, which is within the range of 0.5 to 0.8 times the effective movable diameter thereof. The vibration of the part that has a few peaks/dips in the frequency response is transmitted to the dome-shaped diaphragm 3. Since undesired sound is not radiated from the part other than the panel opening part 4*a*, in other words, since the sounds from the part that has many peaks/dips in the frequency response are blocked off, excellent sound pressure frequency response can be obtained.

Figure 12:
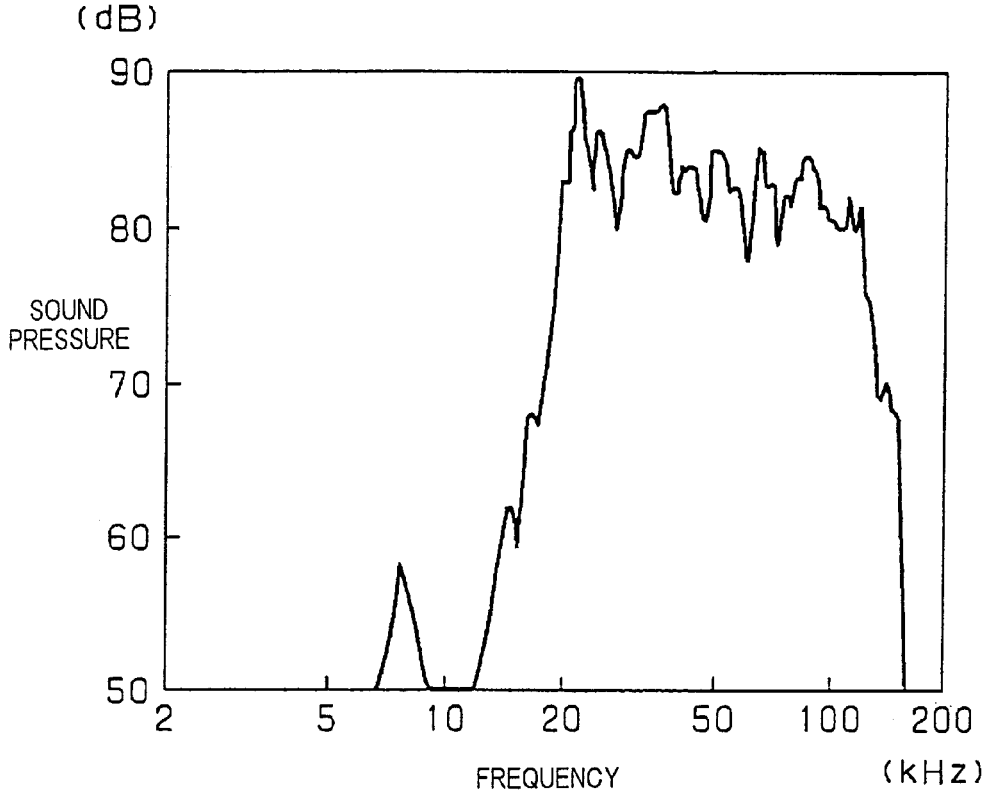
FIG. 12 is a graph of the sound pressure frequency response of the speaker for reproducing ultrahigh frequencies in accordance with Embodiment 1 of the present invention.

FIG. 12 shows the sound pressure frequency response of the speaker for reproducing ultrahigh frequencies of the present embodiment at the time of 2.45 V (1 W/6 ohms) input. From about 20 kHz to ultrahigh frequencies up to 120 kHz, excellent sound pressure frequency response with small peaks/dips and high output sound pressure level of about 84 dB/m can be obtained. In a conventional art, only the output sound pressure level of around 75 dB/m can be obtained by 2.45 V input. The piezoelectric ceramic vibrator 1 is an all-purpose compact circular shaped monomorph type which is extremely broadly used, being extremely inexpensive. Since the speaker of the present invention is one for reproducing ultrahigh frequencies, the voltage boosting coil 2*a* and the capacitor 2*b* of the voltage boosting circuit 2 are very small and inexpensive. The voltage boosting circuit 2 having such parts is very inexpensive. The present invention obtains an inexpensive speaker for reproducing ultrahigh frequencies.

EMBODIMENT 2

A speaker for reproducing ultrahigh frequencies of Embodiment 2 in accordance with the present invention will be described with reference to FIG. 13.

A speaker for reproducing ultrahigh frequencies of Embodiment 2 has the same configuration as that of a speaker for reproducing ultrahigh frequencies of Embodiment 1 shown in FIG. 1. The detailed explanation thereof is omitted.

In Embodiment 1, the primary resonance frequency at high frequencies of the piezoelectric ceramic vibrator 1 is about 7 kHz, the secondary resonance frequency at high frequencies is about 25 kHz, the tertiary resonance frequency at high frequencies is about 50 kHz, and the primary resonance frequency at high frequencies of the dome-shaped diaphragm 3 is about 20 kHz.

In Embodiment 2, the primary resonance frequency at high frequencies of the dome-shaped diaphragm 3 is designed to be higher than the secondary resonance frequency at high frequencies of the piezoelectric ceramic vibrator 1. The dome-shaped diaphragm 3 radiates vibrations (sound waves) of high frequency band, which is efficiently generated by the piezoelectric ceramic vibrator 1, with less loss. According to the configuration of Embodiment 2, it is possible to obtain the speaker having excellent sound pressure frequency response which further extends to ultrahigh frequencies as compared to the speaker of Embodiment 1. The detailed explanation thereof will be described below.

As known well in acoustic vibration theory, if the frequency of the primary (fundamental) mode of the disc, the peripheral part of which is fixed, that is, the primary resonance frequency at high frequencies, is f1, the secondary (the secondary node circle mode) resonance frequency at high frequencies is f2, the tertiary (the tertiary node circle mode) resonance frequency at high frequencies is f3, and the quaternary (the quaternary node circle mode) resonance frequency at high frequencies is f4, f2=3.9×f1, f3=8.7×f1, and f4=14.5×f1.

Only f2/f1 (=3.9) is much larger than f3/f2 (=2.2), f4/f3 (=1.7), respectively. In the frequency band between f1 and f2, the resonance effect is decreased and the radiation efficiency is low, which is obvious from FIG. 3.

On the contrary, since the resonance frequencies at high frequencies are concentrated in the frequency band of f2 or more, the radiation efficiency is high by the resonance effect. Hence, in Embodiment 2, the primary resonance frequency at high frequencies of the dome-shaped diaphragm 3 is f2 or more of the piezoelectric ceramic vibrator 1. According to this configuration, the vibration transmission loss due to the higher split vibration of the dome-shaped diaphragm 3 is not generated in the frequency band with high radiation efficiency in the piezoelectric ceramic vibrator 1. The above-mentioned configuration can obtain a speaker capable of reproducing extremely ultrahigh frequencies.

According to FIG. 3, intervals (actual measurement value) of each resonance frequency at high frequencies of the piezoelectric ceramic vibrator 1 in accordance with Embodiment 1 slightly differ from intervals (theoretical value) of the above-mentioned f1 to f4. It is due to the slight difference from the theoretical ideal state of the vibrator, the peripheral part of which is fixed, since the material for fixing the peripheral part of the piezoelectric ceramic vibrator 1 is made of resin.

In a speaker in accordance with Embodiment 2, the dome-shaped diaphragm 3 is formed of 0.05 mm thick polyimide-containing resin films, the dome part is made to be 4 mm high, and the primary resonance frequency at high frequencies of the dome-shaped diaphragm 3 is designed to be 30 kHz which is higher value than the secondary resonance frequency at high frequencies (about 25 kHz) of the piezoelectric ceramic vibrator 1. The other configurations are identical to those of the embodiments. FIG. 13 shows the sound pressure frequency response of the speaker in accordance with Embodiment 2.

Figure 13:
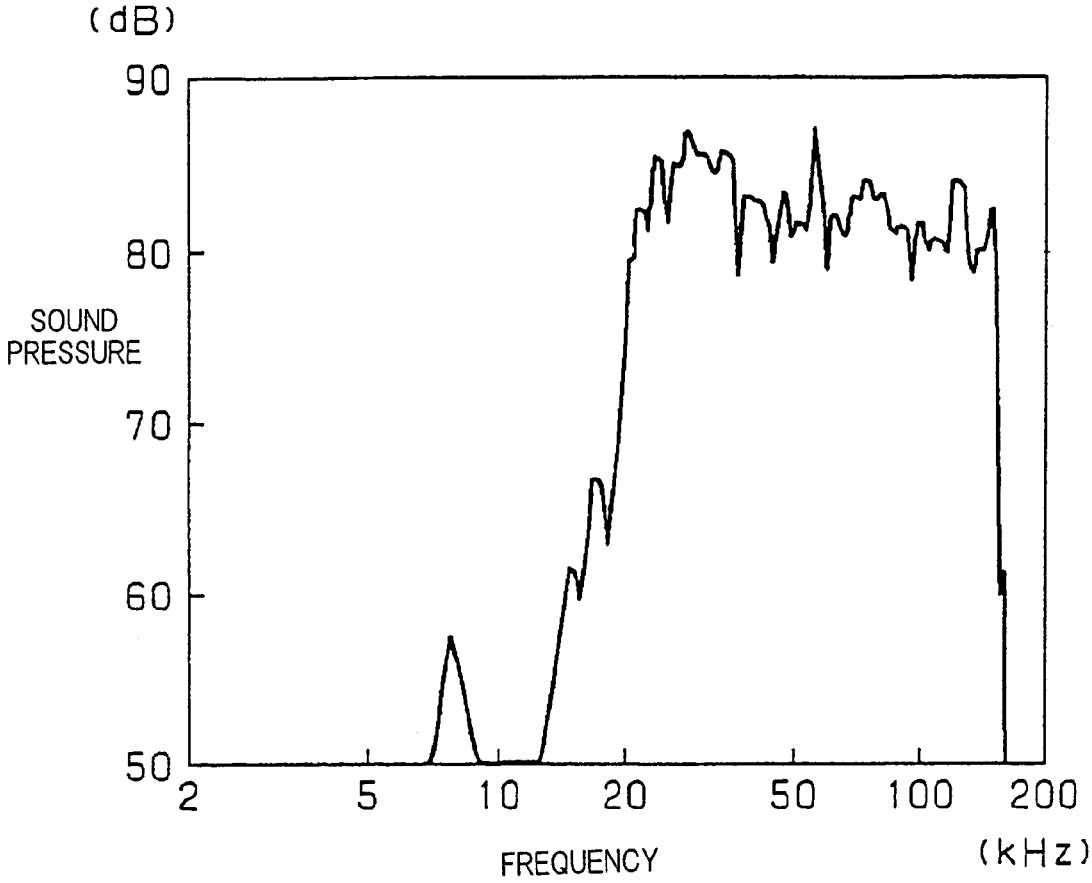
FIG. 13 is a graph of the sound pressure frequency response of the speaker for reproducing ultrahigh frequencies in accordance with Embodiment 2 of the present invention.
Figure 14:
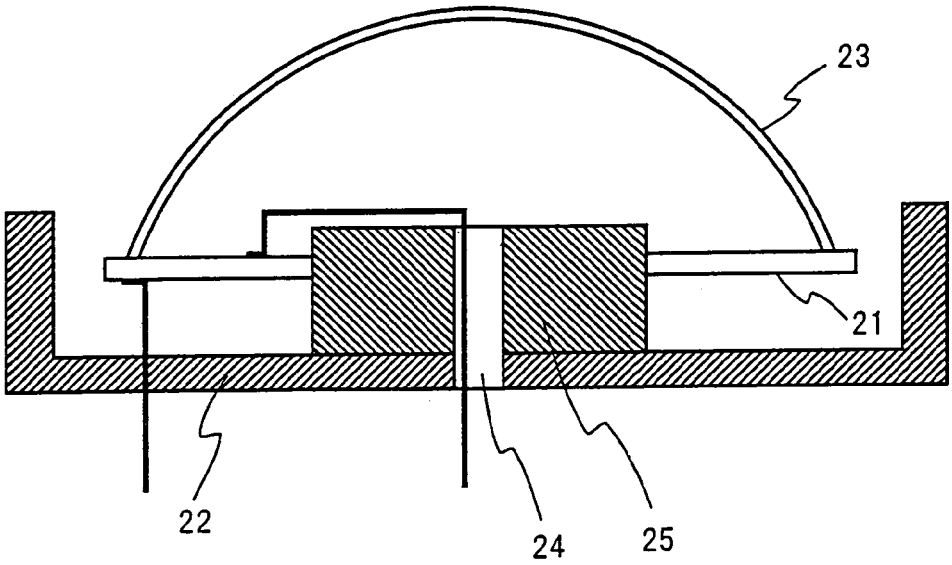
FIG. 14 is a structure view of the speaker for reproducing high frequencies in accordance with a third prior art.
Figure 15:
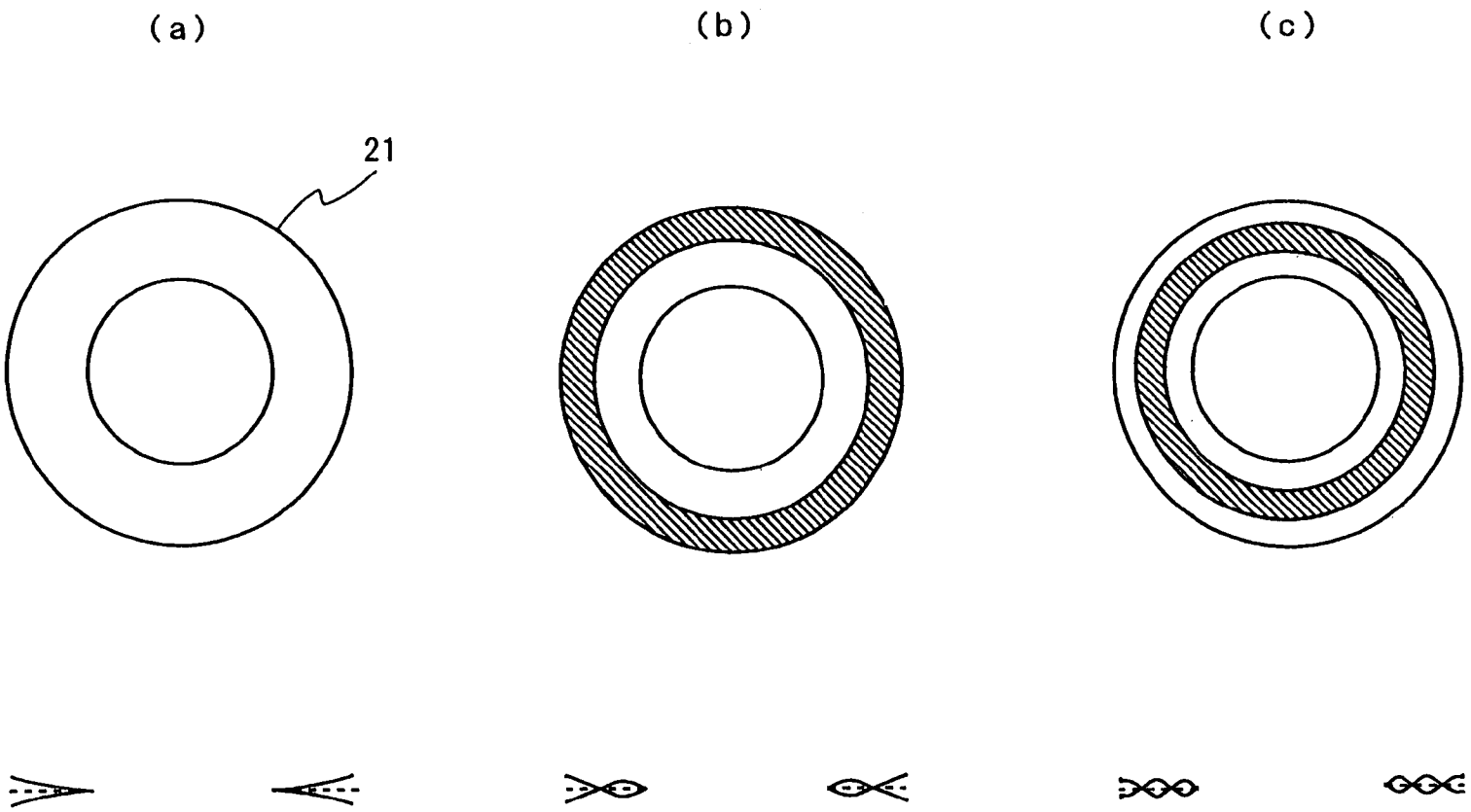
FIG. 15 PRIOR ART
FIG. 15 is a view representing the vibration modes of the piezoelectric ceramic vibrator of the speaker for reproducing ultrahigh frequencies in accordance with the third prior art.
Figure 16:
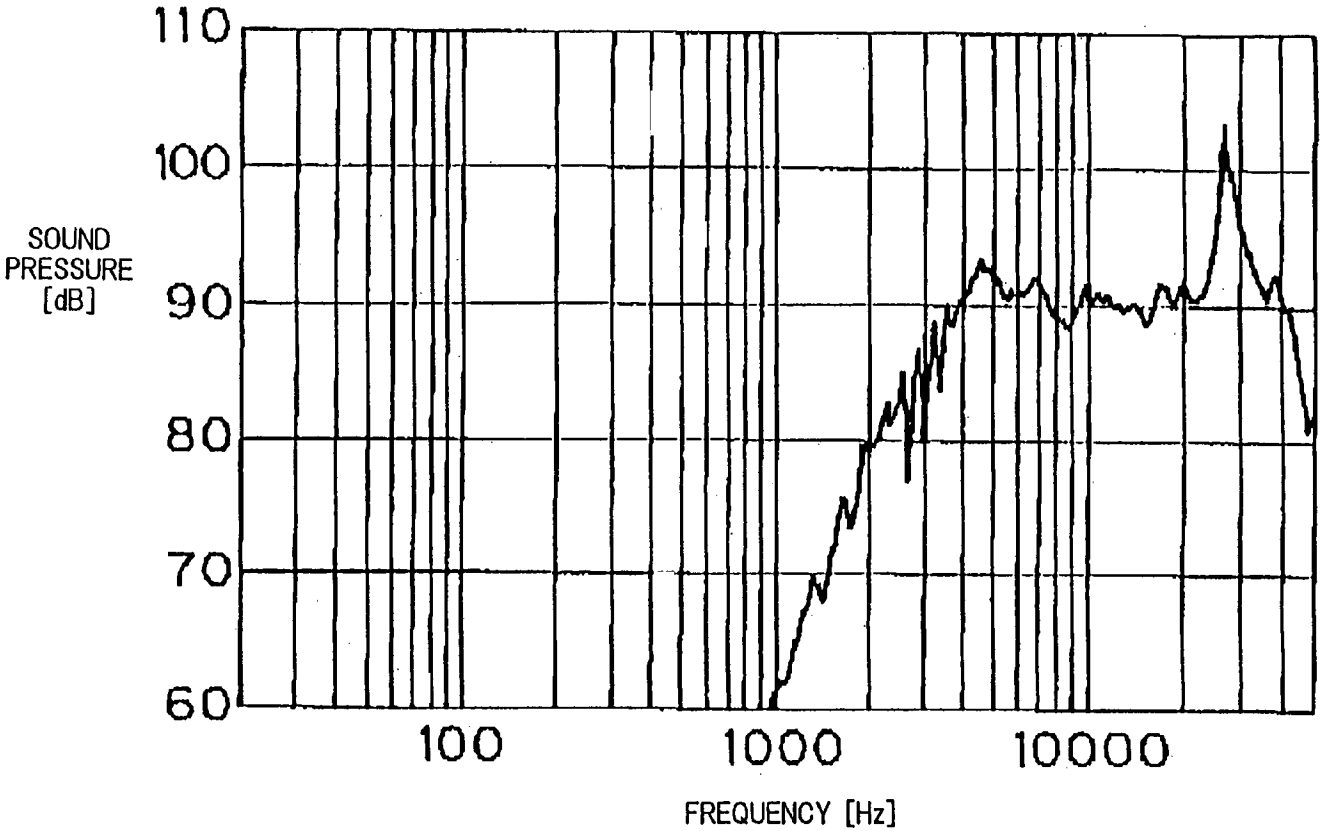
FIG. 16 PRIOR ART
FIG. 16 is the graph of the sound pressure frequency response of the speaker for reproducing ultrahigh frequencies in accordance with the third prior art.

As is clear from comparing FIG. 12 and FIG. 13, in the speaker in accordance with Embodiment 1, the upper limit of the reproducing band is about 120 kHz (FIG. 12), on the other hand, in the speaker in accordance with Embodiment 2, the upper limit of the reproducing band extends to about 150 kHz (FIG. 13).

In the above-mentioned explanation, the speaker of the present invention is compared to the speaker in accordance with the third prior art. The speaker of the present invention will be simply compared to the speakers in accordance with the first and second prior arts.

In the speaker in accordance with the first prior art, the cone-shaped diaphragm, which has a larger irregularity in the frequency response than the dome-shaped diaphragm, is used. The monomorph type piezoelectric ceramic vibrator is contacted with only the top part of the cone-shaped diaphragm, being the small contact area between the diaphragm and the vibrator. Hence, it is hard to transmit well the energy from the ceramic vibrator to the cone-shaped diaphragm. The vibration only in the vicinity of the center of the ceramic vibrator having the large resonance is transmitted to the diaphragm. For the above-mentioned reason, the speaker in accordance with the first prior art has the low sound pressure and the large peak/dip in the sound pressure frequency response.

The speaker in accordance with the second prior art has a cone-shaped diaphragm and the dome-shaped diaphragm contacted with the inner peripheral part of the cone-shaped diaphragm. Since the vibration of the cone-shaped diaphragm and that of the dome-shaped diaphragm interfere each other, the peak/dip of the sound pressure frequency response is large. Since it is hard to transmit the vibration of the piezoelectric vibrator to the cone-shaped diaphragm, the sound pressure is low.

According to the present invention, it is possible to obtain the speaker for reproducing ultrahigh frequencies having high sound pressure level and excellent sound pressure frequency response with small peaks/dips, capable of reproducing the ultrahigh frequency range with excellent directional pattern, and being inexpensive.

In Embodiments 1 and 2, the piezoelectric ceramic vibrator 1 is the monomorph type. However, it goes without saying that the piezoelectric ceramic vibrator 1 can be a bimorph type. The bimorph type piezoelectric ceramic vibrator, due to which has the piezoelectric ceramic sheets being bonded to both sides of the metal plate, has twice the driving force as compared to the monomorph type piezoelectric ceramic vibrator in which the piezoelectric ceramic is bonded to only one side of the metal plate. By using the bimorph type piezoelectric ceramic vibrator, a speaker with higher output can be obtained without changing response.

The piezoelectric ceramic 1*a* and the metal substrate 1*b* do not have to be the disc shape. In the case of using a vibrator having a shape other than a circular shape, the vibration mode of the vibrator is more decentralized than the case of using the circular shaped vibrator and the vibration level becomes a tendency to be lowered. In consideration of this matter, it is possible to design appropriately in order to obtain the desired response.

By designing the piezoelectric ceramic vibrator to be the disc shape, it is possible to use widely distributed inexpensive commercial all-purpose parts. By designing the piezoelectric ceramic vibrator to be the disc shape, it is possible to obtain the most inexpensive speaker.

In Embodiments 1 and 2, the piezoelectric ceramic vibrator 1 is designed to be the disc shape and is fixed to the inner peripheral part of the panel. It is possible to design the piezoelectric ceramic vibrator to be non-circular shapes such as polygonal shape, elliptical shape or the like other than the circular shape. In this case, the effective movable diameter of the piezoelectric ceramic vibrator can be represented by the diameter of the circular shape having an identical area to the non-circular shape.

In Embodiment 1 and 2, the peripheral part of the piezoelectric ceramic vibrator 1 is fixed by the panel 4. The peripheral part of the piezoelectric ceramic vibrator 1 can be fixed by using a member different from the panel having the opening part in the front face of the dome-shaped diaphragm.

In Embodiment 1 and 2, the narrow ring-shaped part of 19 mm to 20 mm diameter in the peripheral part of the piezoelectric ceramic vibrator 1 (20 mm diameter) is fixed. The area of the fixed part in the peripheral part of the piezoelectric ceramic vibrator 1 can be wider. In the case that, for example, a 16 mm to 20 mm diameter area in the peripheral part of the piezoelectric ceramic vibrator 1 (20 mm diameter) is fixed, the effective movable diameter becomes 16 mm. In this configuration, the diameter of the dome part of the dome-shaped diaphragm 3 is designed to be 8 mm to 12.8 mm diameter which is 0.5 to 0.8 times 16 mm.

In the case that the member which fixes the piezoelectric ceramic vibrator is low in rigidity, as in the case, for example, that the fixing member is made of resin with thin wall thickness or the like, the peripheral part of the piezoelectric ceramic vibrator does not become a fixed state completely. In this case, the effective movable diameter of the piezoelectric ceramic vibrator becomes larger than the fixed inner peripheral diameter and becomes an intermediate value of the fixed inner peripheral diameter and the outer diameter of the piezoelectric ceramic vibrator. In the case that the member which fixes the piezoelectric ceramic vibrator is high in rigidity, as in the case, for example, that the fixing member is made of metal or resin with efficient thick wall thickness, the effective movable diameter of the piezoelectric ceramic vibrator can be considered to be almost identical to the fixed inner peripheral diameter. In the case that the adhesive by which the piezoelectric ceramic vibrator is fixed to the fixing member is low in rigidity, as in the case, for example, that the piezoelectric ceramic vibrator is fixed by applying the soft adhesive thickly, the effective movable diameter becomes larger than the fixed inner peripheral diameter regardless of the high rigidity of the fixing member.

In Embodiment 1 and 2, the voltage boosting coil 2*a* is an autotransformer. Instead of this autotransformer, the normal transformer with separated primary and the secondary windings can be used as a voltage boosting coil. The electrical performance of alternating-current of the transformer with separated primary and secondary windings is entirely same as that of the commonly called autotransformer with the primary and secondary windings that share a common part.

In Embodiment 1 and 2, the resistor 2*c* is connected in serial to the capacitor 2*b* of the voltage boosting circuit 2. The resistor 2*c* adjusts Q of the resonance point in the vicinity of the lower cut-off frequency to be low and the sound pressure frequency response in the vicinity of the lower cut-off frequency (about 20 kHz) to be flat. In the case that the predetermined performance can be obtained, the resistor 2*c* can be eliminated.

In the case that the average sound pressure frequency level of the speaker is efficiently high, the voltage boosting circuit 2 connected to the piezoelectric ceramic vibrator 1 can be eliminated.

In Embodiment 1 and 2, polyethylene terephtalate or polyimide-containing resin films are used as the material of the dome-shaped diaphragm 3. The material thereof can not be limited to them and a given material can be used as the material of the diaphragm. For example, a metallic titanium foil, a paper, various resin films and the like can be used as the diaphragm.

The piezoelectric ceramic vibrator of the monomorph or bimorph types generally has a metal substrate of 0.15 mm to 0.25 mm thick. As the dome-shaped diaphragm, the resin films of around 0.05 mm thick, titanium foils of around 0.025 mm thick, or the like is generally used because they can be formed easily and are lightweight. The dome-shaped diaphragm using these materials is far lighter than the piezoelectric ceramic vibrator. Depending on the material of the dome-shaped diaphragm, the vibration characteristics of the piezoelectric ceramic vibrator can not be changed largely.

In Embodiment 1 and 2, the diameter of the opening part 4*a* is identical to that of the dome-shaped diaphragm 3, but slight difference can be allowed. In the case that the diameter of the opening part 4*a* is made to be identical or less than that of the dome part, since the flange around the dome part, the adhesive squeezed out and so on become hard to be seen from the surface, the speaker of high-definition in appearance can be obtained. If the front face of the panel 4 is made to be horn shape, directional pattern becomes narrow, but the sound pressure level can be higher.

In Embodiment 1 and 2, the dome-shaped diaphragm 3 is coaxially disposed with the piezoelectric ceramic vibrator 1 without eccentricity, but some slight eccentricity of them can be allowed. In the case that the eccentricity of them is large, the peak/dip in the sound pressure frequency response of the speaker is decentralized, but the sound pressure level becomes a tendency to be lowered. In consideration of this, it is possible to design the speaker with intentional eccentricity.

In Embodiment 1 and 2, the shape of the front face of the dome-shaped diaphragm 3 is the circular shape. Instead of this shape, it is possible to use a dome-shaped diaphragm in the shape of an ellipse, an oval and the like. If the diaphragm in the shape of an ellipse or an oval is used, the peak/dip in the sound pressure frequency response of the speaker is decentralized, but the sound pressure level becomes a trend to be lowered. In this case, the average between the major and minor axis of the ellipse or the oval (or the diameter of the circle having the identical area to the area thereof) can be designed to be 0.5 to 0.8 times the effective movable diameter of the piezoelectric ceramic vibrator 1.

In Embodiment 1 and 2, the shape of the dome-shaped diaphragm 3 is a spherical-shaped dome. Instead of-this shape, the dome-shaped diaphragm in the shape of a cone or a shell can be used. Since the dome-shaped diaphragm 3 is far lighter than the piezoelectric ceramic vibrator 1, in the case that the shape of the dome-shaped diaphragm 3 is changed, the directional pattern of the speaker is changed, but the vibration characteristics (the sound pressure frequency response) of the piezoelectric ceramic vibrator 1 are hardly affected.

It goes without saying that the present invention is not limited to within the above described examples. Although the invention has been described in its preferred form with a certain degree of particularity, it is understood that the present disclosure of the preferred form may be changed in the details of construction and the combination and arrangement of parts may be resorted to without departing from the spirit and the scope of the invention as hereinafter claimed.

In the speaker for reproducing ultrahigh frequencies in accordance with the present invention, in addition to fixing the peripheral part of the piezoelectric ceramic vibrator, by the configuration in which the dome outer diameter of the dome-shaped diaphragm is made to be 6.5 to 0.8 times the effective movable diameter of the piezoelectric ceramic vibrator, the vibration of the part having small peaks/dips of the piezoelectric ceramic vibrator is transmitted to the dome-shaped diaphragm. Hence, the excellent sound pressure frequency response can be obtained. Since undesired sound is not radiated from the part other than the opening part of the panel substantially exposing only the dome-shaped diaphragm, the sound pressure frequency response becomes better and the excellent directional pattern can be obtained.

The diameter of the piezoelectric ceramic is made to be almost identical to that of the dome part, thereby obtaining an efficient speaker for reproducing ultrahigh frequencies in which most vibrations generated by the piezoelectric ceramic are radiated from the dome-shaped diaphragm.

Connecting the voltage boosting circuit to the ceramic vibrator makes the drive voltage of the ceramic vibrator higher. Hence, by using the dome-shaped diaphragm with a small diameter, the speaker with high sound pressure level can be obtained. The speaker with wide directional pattern can be obtained by the dome-shaped diaphragm with a small diameter.

The primary resonance frequency at high frequencies of the dome-shaped diaphragm is made to be higher than the secondary resonance frequency at high frequencies of the above-mentioned piezoelectric ceramic vibrator, whereby the speaker for reproducing the extremely ultrahigh frequencies can be obtained without the vibration transmission loss due to the high split vibration of the dome-shaped diaphragm in the frequency band which is high radiation efficiency of the piezoelectric ceramic vibrator. This configuration enables the speaker for reproducing ultrahigh frequencies to obtain excellent response which extends further up to ultrahigh frequencies as compared to the above-mentioned speaker.

In the speaker of the present invention, it is possible to use a compact circular shaped all-purpose monomorph type piezoelectric ceramic vibrator which is extremely widely used. Since the speaker in accordance with the present invention is ultrahigh in reproducing frequencies, it is possible to form the voltage boosting circuit with compact inexpensive parts.

According to the present invention, it is possible to obtain the inexpensive speaker for reproducing ultrahigh frequencies having excellent sound pressure frequency response with high sound pressure level and a small number of peaks/dips, having excellent directional pattern and capable of reproducing up to ultrahigh frequencies.

Although the invention has been described in its preferred form with a certain degree of particularity, it is understood that the present disclosure of the preferred form may be changed in the details of construction and the combination and arrangement of parts may be resorted to without departing from the spirit and the scope of the invention as hereinafter claimed.

INDUSTRIAL APPLICABILITY

The speaker for reproducing ultrahigh frequencies according to the present invention is useful as the speaker for acoustic devices such as a DVD-Audio reproducing apparatus, a Super Audio CD reproducing apparatus and the like.

The invention claimed is:

1. A speaker for reproducing ultrahigh frequencies comprising:

a schematically disk-shaped piezoelectric ceramic vibrator in which a piezoelectric ceramic and a metal substrate are bonded;

a dome-shaped diaphragm attached to said piezoelectric ceramic vibrator;

a voltage boosting circuit connected to said piezoelectric ceramic vibrator and configured to multiply an input drive voltage and apply a boosted drive voltage to said piezoelectric ceramic vibrator; and a panel which fixes an outer peripheral part of said piezoelectric ceramic vibrator and has an opening part in a front face of said dome-shaped diaphragm; wherein a diameter of a dome part of said dome-shaped diaphragm is made to be 0.5 to 0.8 times an effective movable diameter of said piezoelectric ceramic vibrator; and the diameter of said piezoelectric ceramic is almost identical to that of said dome part.

2. A speaker for reproducing ultrahigh frequencies comprising:

a schematically disk-shaped piezoelectric ceramic vibrator in which a piezoelectric ceramic and a metal substrate are bonded;

a dome-shaped diaphragm attached to said piezoelectric ceramic vibrator;

a voltage boosting circuit connected to said piezoelectric ceramic vibrator and configured to multiply an input drive voltage and apply a boosted drive voltage to said piezoelectric ceramic vibrator; and a panel which fixes an outer peripheral part of said piezoelectric ceramic vibrator and has an opening part in a front face of said dome-shaped diaphragm; wherein a diameter of a dome part of said dome-shaped diaphragm is made to be 0.5 to 0.8 times an effective movable diameter of said piezoelectric ceramic vibrator; and a primary resonance frequency at high frequencies of said dome-shaped diaphragm is made to be higher than a secondary resonance frequency at high frequencies of said piezoelectric ceramic vibrator.

* * * * *